US006889747B2

(12) United States Patent
Graham

(10) Patent No.: US 6,889,747 B2
(45) Date of Patent: May 10, 2005

(54) FLUIDIZED BED WITH BAFFLE

(75) Inventor: Lawrence D. Graham, Chagrin Falls, OH (US)

(73) Assignee: PCC Airfoils, Inc., Cleveland, OH (US)

( * ) Notice: Subject to any disclaimer, the term of this patent is extended or adjusted under 35 U.S.C. 154(b) by 48 days.

(21) Appl. No.: 10/379,168

(22) Filed: Mar. 4, 2003

(65) Prior Publication Data

US 2004/0173336 A1 Sep. 9, 2004

(51) Int. Cl.[7] ..... B22D 27/04

(52) U.S. Cl. ..... 164/122.1; 164/122.2; 164/338.1

(58) Field of Search ..... 164/122.1, 122.2, 164/338.1

(56) References Cited

U.S. PATENT DOCUMENTS

| | | | |
|---|---|---|---|
| 3,714,977 A | 2/1973 | Terkelsen | |
| 3,810,504 A | 5/1974 | Piwonka | |
| 4,108,236 A | 8/1978 | Salkeld | |
| 4,573,516 A | 3/1986 | Quested et al. | |
| 4,763,716 A | 8/1988 | Graham et al. | |
| 4,774,992 A | 10/1988 | George | |
| 4,969,501 A | 11/1990 | Brokloff et al. | |
| 6,035,924 A | 3/2000 | Graham | |
| 6,443,213 B1 | 9/2002 | Graham et al. | |
| 6,695,034 B2 * | 2/2004 | Graham | 164/122.1 |

FOREIGN PATENT DOCUMENTS

| | | |
|---|---|---|
| JP | 54-106031 | 8/1979 |

* cited by examiner

*Primary Examiner*—Kuang Y. Lin
(74) *Attorney, Agent, or Firm*—Tarolli, Sundheim, Covell & Tummino L.L.P.

(57) ABSTRACT

An apparatus for use in casting a metal article includes a furnace assembly and a container which holds a fluidized bed. A mold support is movable relative to the furnace assembly to move a mold from the furnace assembly into the fluidized bed. A bame is disposed between the fluidized bed and at least a portion of the furnace assembly. The baffle may have a plurality of secondary openings which enable particulate to move from an upper side of the baffle into the fluidized bed. The baffle may be connected with the furnace assembly, the container which holds the fluidized bed, or floated on the fluidized bed itself. The baffle may be provided with flexible segments which engage the mold and at least partially block movement of particulate through a central opening in the baffle during withdrawal of the mold from the furnace assembly.

47 Claims, 3 Drawing Sheets

FLUIDIZED BED WITH BAFFLE

BACKGROUND OF THE INVENTION

The present invention relates to a new and improved method and apparatus for casting a metal article. More specifically, the invention relates to the use of a baffle in association with a fluidized bed into which a mold is moved.

An apparatus for use in casting a metal article is disclosed in U.S. Pat. No. 4,573,516. This apparatus includes a furnace assembly and a mold which is filled with molten metal. The apparatus also includes a fluidized bed which is disposed below the furnace assembly. The mold is lowered from the furnace assembly into the fluidized bed to effect solidification of the molten metal in the mold.

Another apparatus for use in casting metal articles and utilizing a fluidized bed is disclosed in U.S. Pat. No. 6,035,924. This apparatus includes a furnace assembly from which a mold containing molten metal is lowered into a fluidized bed. A layer of hollow spherical bodies is disposed on an upper end portion of the fluidized bed.

Another apparatus and method for use in casting a metal article is disclosed in U.S. Pat. No. 6,443,213. This patent discloses a furnace assembly from which a mold is lowered into a fluidized bed. Still another apparatus for use in casting a metal article is disclosed in Japanese Laid-Open Patent Application No. 54-106031. This publication discloses a mold which is lowered from a furnace assembly into a fluidized bed.

SUMMARY OF THE INVENTION

The present invention relates to a new and improved method and apparatus for use in casting a metal article. During casting of the metal article, a mold is moved into a fluidized bed. A baffle is provided to retard heat transfer from the furnace assembly to a fluidized bed during heating of a mold in the furnace assembly. In addition, the baffle retards transfer of heat from a portion of the mold disposed outside of the fluidized bed to the fluidized bed during movement of the mold into the fluidized bed.

The baffle may be connected with the furnace assembly. Alternatively, the baffle may be connected with a container which holds the fluidized bed. As another alternative, the baffle may float on the fluidized bed. Regardless of how the baffle is supported, the baffle may be provided with flexible segments which engage the mold during movement of the mold through a central opening in the baffle to at least partially block movement of particulate through the central opening in the baffle and to block radiation of heat through the central opening in the baffle.

The baffle may have a central opening and a plurality of secondary openings. The secondary openings enable particulate to move from an upper side of the baffle into the fluidized bed. This tends to minimize accumulation of particulate on the upper side of the baffle. If desired, the secondary openings may be omitted.

It should be understood that any one of the features mentioned above and/or additional features may be utilized by itself or in combination with other features of the invention. It should also be understood that the invention is not to be limited to any one of the specific embodiments disclosed herein. This is because there are many different ways in which the various features of the invention may be used together or separately and in which they may be changed from the specific embodiments disclosed herein.

BRIEF DESCRIPTION OF THE DRAWINGS

The foregoing and other features of the invention will become more apparent upon consideration of the following description taken in connection with the accompanying drawings wherein.

DESCRIPTION OF SPECIFIC PREFERRED EMBODIMENTS OF THE INVENTION

General Description

Figure 1:
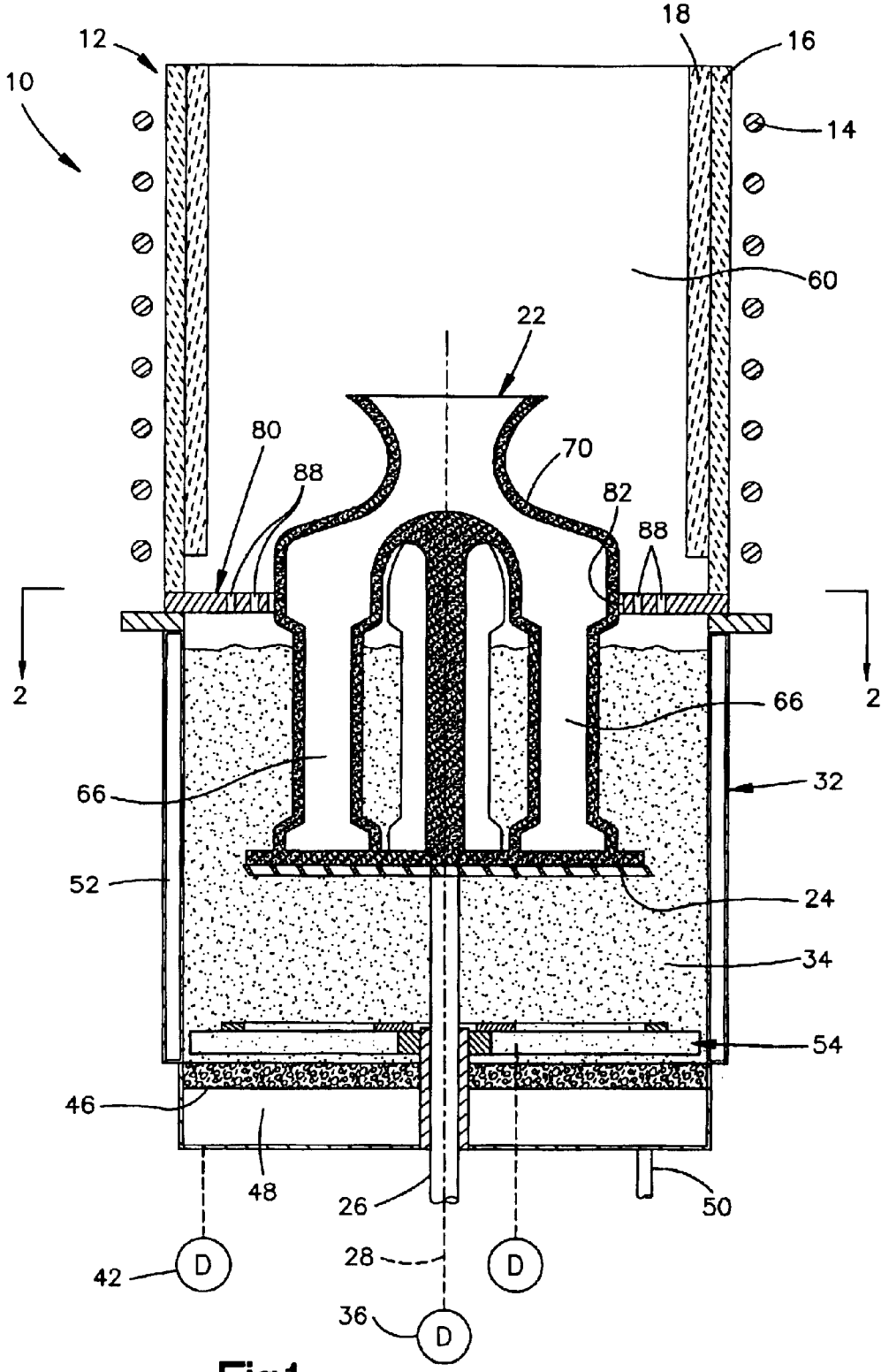
FIG. 1. is a schematic sectional view of one embodiment of an apparatus for use in casting a metal article and depicting the relationship between a furnace assembly, a mold, and a fluidized bed during movement of the mold into the fluidized bed.

A casting apparatus 10, which is constructed and operated in accordance with one or more of the features of the present invention, is illustrated schematically in FIG. 1. The casting apparatus 10 includes a furnace assembly 12 which is of the known induction type and includes an induction coil 14. The coil 14 is located in a surrounding relationship with a cylindrical refractory wall 16 of the furnace assembly 12. A cylindrical radiation liner 18 is provided within the refractory wall 16. A cover (not shown) may be provided over an upper end portion of the furnace assembly 12.

A suitable mold 22 is disposed on a movable support 24. A shaft 26 is connected with the mold support 24. The shaft 26 is movable along an axis 28 to raise and lower the mold support 24 relative to the furnace assembly 12 and a container 32 in which a fluidized bed 34 is disposed.

A drive assembly 36 is connected with the shaft 26 and is operable to move the shaft along its central axis 28. The central axis 28 of the shaft 26 is coincident with a central axis of the cylindrical furnace assembly 12 and the cylindrical container 32.

A container drive assembly 42 is connected with the container 32 and is operable to raise and lower the container and fluidized bed 34 relative to the furnace assembly 12. A porous layer 46 is provided in a lower end portion of the container 32 and cooperates with the container to form a plenum chamber 48. The plenum chamber 48 is connected with a source of gas (argon) under pressure through a conduit 50.

Pressurized gas flows from the plenum chamber 48 through the porous layer 46 to fluidized granular material and form the fluidized bed 34. A water cooling passage or jacket 52 extends around the container 32 and is effective to cool the fluidized bed 34. A stirrer assembly 54 may be provided in the lower portion of the fluidized bed 34 to promote an even distribution of particulate in the fluidized bed. However, if desired, the stirrer assembly 54 may be omitted.

The fluidized bed 34 is formed of particles suspended in a flow of gas. The gas may be argon. The particles may be alumina particles of 325 to 90 mesh size. Although the particles may be formed of alumina, it is believed that it may be preferred to use zircon particles which have a more rounded configuration than alumina particles. For example, it may be preferred to form the fluidized bed 34 by conducting gas through 200 mesh zircon particles. It should be understood that a gas and/or particulate other than the specific gas and/or particulate set forth herein may be used to form the fluidized bed 34.

Prior to fluidization of the bed 34, the particulate in the container 32 is supported by the cylindrical porous layer 46. When the bed 34 is to be fluidized, gas under pressure is conducted into the plenum chamber 48 through the conduit 50. When a predetermined minimum pressure, which is a function of the height fluidized bed 34, is obtained in the plenum chamber 48, a flow of gas is conducted from the plenum chamber through the porous layer 46 into the particulate. The flow of gas is effective to form the fluidized bed 34.

When the particulate in the container 32 becomes fluidized, the bed 34 shimmers and particles of particulate are suspended in the flow of gas through the bed. The smooth shimmering effect of the fluidized bed 34 is maintained as the fluid pressure in the plenum chamber 48 is increased to a predetermined maximum pressure.

The casting apparatus 10 may include a housing assembly having an upper housing and a lower housing. The furnace assembly 12 may be disposed in the upper housing. The lower housing has a loading chamber in which the container 32 and mold 22 may be lowered by operation of the drive assemblies 42 and 36. It is believed that the housing assembly and furnace assembly 12 may be constructed in the same manner as is disclosed in U.S. Pat. No. 3,841,384.

When the mold 22 is to be utilized to form one or more cast metal articles, a door to the lower housing is opened with the container 32 and mold support 24 in their lowered positions. The mold is placed on the mold support 24 while the empty mold support is disposed slightly above the container 32.

Particulate within the container 32 is then fluidized to enable the mold support 24 to be lowered into the container. Once the particulate in the container 32 has been fluidized, the mold support drive assembly 36 is operated to lower the mold support 24 into the fluldized bed in the container 32.

The door of the lower housing is then closed and the upper and lower housings are connected in fluid communication with a source of vacuum. This results in a cylindrical heating chamber 60 in the furnace assembly 12 being evacuated. The mold support drive assembly 36 is then operated to move the mold 22 upward into the furnace assembly 12.

After the mold 22 has been moved into the furnace assembly 12, the container 32 is moved to the raised position shown in FIG. 1 by operation of the container drive assembly 42. The container drive assembly 42 moves the container 32 and fluidized bed 34 to a location immediately beneath the furnace assembly 12. At this time, the mold support 24 is disposed above the container 32. The fluidized bed 34 in the container is disposed immediately beneath the furnace assembly 12 and is spaced from the mold support 24.

In the foregoing description of movement of the mold 22 into the furnace assembly 12, the mold has first been moved into the fluidized bed! 34. The mold 22 is then withdrawn from the fluidized bed 34 and moved into the furnace assembly 12, while the container 32 holding the fluidized bed 34 is stationary. The stationary container 32 and fluidized bed 34 are subsequently moved upward to the position illustrated in FIG. 1 beneath the furnace assembly 12, while the mold 46 is stationary in the furnace assembly.

It should be understood that the mold 22 and container 32 can be moved relative to the furnace assembly 12 in a different manner if desired. For example, the mold 22 may be moved into the furnace assembly 12 before gas is conducted into the container 32 to fluidized the particulate in the container. If this is done, the container 32 may be moved to the raised position illustrated in FIG. 1 with the fluidized bed 34 in a de-fluidized condition. The mold 22 and container 32 may be raised together, with the mold above the container, by effecting simultaneous operation of the mold support drive assembly 36 and container drive assembly 42. The bed 34 may be fluidized, by a flow of gas into the container 32 either before or after the container 32 is moved from the lowered position to the raised position.

Alternatively, the bed 34 may be fluidized and the mold 22 moved into the bed while the container 32 is in the lowered position. The container 32 and mold 22 may be then moved together to the raised position with the mold in the fluidized bed 34, by effecting simultaneous operation of the mold support drive assembly 36 and the container drive assembly 42. The mold support drive assembly 36 would then be operated to move the mold 22 out of the raised container 32 into the furnace assembly 12.

While the mold 22 is disposed in the furnace assembly, the mold is heated to a temperature between 2,500 degrees Fahrenheit and 3,000 degrees Fahrenheit. At this time, the fluid pressure in the heating chamber 60 of the furnace assembly 12 is between $6\times10^{-4}$ atmospheres and 1.0 atmosphere. It should be understood that the specific temperatures and pressures in the furnace assembly 12 may vary depending upon the characteristics of the molten metal to be poured into the mold. It is contemplated that other temperatures and pressures may be utilized.

Once the mold 22 has been heated to a desired temperature in the furnace assembly 12, the mold is filled with molten metal. In the specific embodiment of FIG. 1, the molten metal is a nickel-chrome superalloy. However, it is contemplated that other known types of metal may be utilized. For example, the metal may be titanium.

Shortly after the mold 22 has been filled with molten metal, the mold is lowered into the fluidized bed 34. To lower the mold 22 into the raised fluidized bed 34, the mold support drive assembly 36 is operated to lower the mold support 24 while the container 32 is held stationary relative to the furnace assembly 12 by the container drive assembly 42.

If desired, the mold 22 may be lowered into the fluidized bed 34 only far enough to completely immerse in the fluidized bed the portion of the mold in which article mold cavities 66 are disposed. A gating system 70 which extends between the article mold cavities 66 does not have to be completely immersed into the fluidized bed. However, it is believed that it will probably be desired to lower the mold 22 at least far enough into the fluidized bed 34 so as to immerse the lower end portion of the gating system 70 in the fluidized bed.

Once the mold 22 has been lowered into the fluidized bed 34, the mold support drive assembly 36 and container drive assembly 42 are operated to simultaneously lower the mold and the container 32. When the container ~32 has been moved to a lowered position, the mold 22 will still be immersed in the fluidized bed 34. The fluid pressure, that is, argon gas pressure, in a housing assembly enclosing the furnace assembly 12 and container 32 is then vented to atmosphere.

Once the housing enclosing the furnace assembly 12 and container 32 has been vented to atmosphere, the mold 22 is removed from the housing assembly with solidified molten metal in the mold. The next succeeding mold may then be positioned on the mold support 24. Molten metal is then cast in the next succeeding mold in the manner previously described in conjunction with the mold 22.

The construction and method of operation of the casting apparatus 10 is the same as is disclosed in U.S. Pat. No. 6,443,213. The disclosure from the aforementioned U.S. Pat. No. 6,443,213 is hereby incorporated herein in its entirety by this reference thereto. It should be understood that the casting apparatus 10 may have any of the constructions and/or modes of operation disclosed in U.S. Pat. No. 6,443, 213.

If desired, the container 32 may have an annular cross-sectional configuration as viewed in a plane perpendicular to the axis 28. This would result in the fluidized bed 34 having an annular configuration. The annular container and fluidized bed may be part of an apparatus 10 having the same construction and mode of operation as is disclosed in U.S. patent application Ser. No. 10/189,656 filed Jul. 3, 2002 by Lawrence D. Graham, et al. and entitled System for Casting a Metal Article (Publication No. US-2002-0170698A1, published Nov. 21, 2002). The disclosure in the aforementioned application Ser. No. 10/189,656 is hereby incorporated herein in Its entirety by this reference thereto.

Baffle

In accordance with a feature of the present invention, a baffle 80 is provided between the fluidized bed 34 and at least a portion of the furnace assembly 12. The baffle 80 has a central opening 82 (F1 g. 2). At least a portion of the mold 22 moves through the opening 82 during movement of the mold from the heating chamber 60 of the furnace assembly 12 into the fluidized bed 34.

The baffle 80 is effective to retard transfer of heat from the mold structure 22 and furnace assembly 12 to the fluidized bed 34 during heating of the mold structure in the furnace assembly. In addition, the baffle 80 is effective to retard transfer of heat from the heating chamber 60 of the furnace assembly 12 and the portion of the mold in the heating chamber to the fluidized bed 34 during withdrawal of the mold 22 from the heating chamber. In addition, the baffle 80 is effective to retard movement of particulate from the fluidized bed 34.

Figure 2:
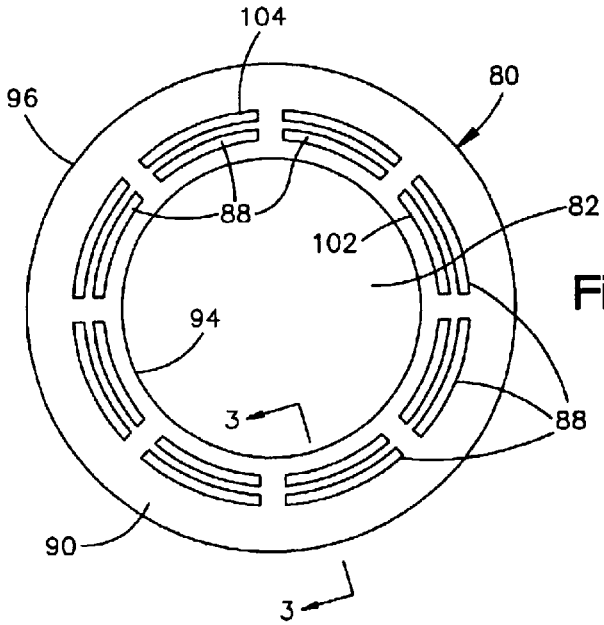
FIG. 2. is a schematic plan view, taken generally along the line 2—2 of FIG. 1, illustrating the construction of a baffle which is disposed between the fluidized bed and at least a portion of the furnace assembly.

The illustrated baffle 80 has an annular construction with a circular central opening 82 (FIG. 2). However, it is contemplated that the baffle 80 may have a construction which is not annular. The baffle 80 may be constructed with either a circular or a noncircular central opening 82. When a plurality of articles are to be cast or when the mold 22 has projecting portions, the baffle 80 may be constructed with a noncircular central opening 82. The noncircular central opening 82 may have lobes in which article mold portions of a mold are received. The diametrically outer peripheral edge portion of the illustrated baffle 80 is circular. However, the outer peripheral edge portion of the baffle 80 may have a noncircular configuration if desired.

The baffle 80 facilitates the establishment of a relatively large temperature differential between the heating chamber 60 of the furnace assembly 12 and the fluidized bed 34 in the container 32 (FIG. 1). This is because the baffle 80 is effective to at least partially block radiant heat transmission between the heating chamber 60 of the furnace assembly 12 and the fluidized bed 34.

The temperature differential between the heating chamber 60 and the fluidized bed 34 is sufficient to maintain a solidification front between liquid metal in the article mold cavity 66 and solidified metal at a location adjacent to the baffle 80 during movement of mold 22 into the fluidized bed 34. Thus, the solidification front between the molten and solidified metal in the article mold cavity 66 is maintained horizontal and in general alignment with the upper surface of the fluidized bed 34 as the mold 22 is withdrawn from the furnace assembly 12.

If the mold 22 is moved at a relatively rapid rate from the heating chamber 60 of the furnace assembly 12 into the fluidized bed 34, the molten metal in the article mold cavity 66 may solidify with an equiaxed crystallographic structure. However, if the mold 22 is withdrawn at a slower rate from the heating chamber 60, the molten metal in the article mold cavity 66 may solidify with a columnar grain crystallographic structure. If the article mold cavity 66 in the mold 22 is associated with a single crystal starter, such as is disclosed in U.S. Pat. No. 5,062,468, and the mold is withdrawn slowly from the heating chamber 60, the molten metal may solidify with a single crystal crystallographic structure.

The baffle 80 has sufficient rigidity to maintain its original shape during withdrawal of the mold 22 from the heating chamber 60. Although the mold 22 may engage a portion of the baffle 80, there is no significant deformation of the baffle during withdrawal of the mold from the heating chamber 60 and movement of the mold into the fluidized bed 34. Thus, during withdrawal of the mold 22 from the furnace assembly 12, the baffle 80 maintains its original configuration.

The baffle 80 may have a layered construction composed of one or more layers of graphite felt and/or graphite foil. The graphite felt may be enclosed by the layers of graphite foil. However, it should be understood that the baffle 80 could be formed of a different material and in a different manner if desired. For example, the baffle 80 may be formed of a suitable ceramic or a suitable refractory metal. Rather than having a multi-layered construction, the baffle 80 may be formed by a single piece of graphite felt or other material. It should be understood that the baffle 80 must be capable of withstanding relatively high temperatures. This is because the temperature in the heating chamber 60 of the furnace assembly 12 is approximately 3,000 degrees Fahrenheit during preheating of the mold 22.

The baffle 80 may be formed as a single piece. Alternatively, the baffle 80 may be formed of a plurality of pieces. If the baffle 80 is formed by a plurality of pieces, each of the pieces may be interconnected with suitable fasteners, such as staples, or with a suitable adhesive.

Figure 3:
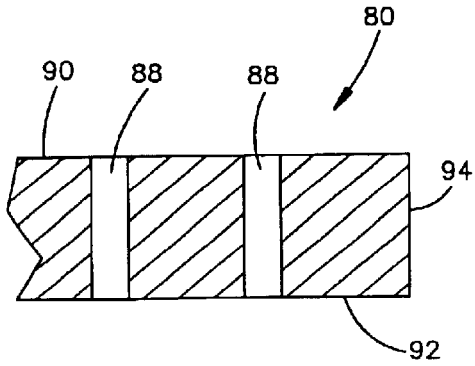
FIG. 3. is an enlarged schematic fragmentary sectional view, taken generally along the line 3—3 of FIG. 2, illustrating the construction of secondary openings through which particulate may move from an upper side of the baffle into the fluidized bed.

In accordance with one of the features of the present invention, the baffle 80 may advantageously be provided with a plurality of secondary openings 88 (FIGS. 2 and 3). The secondary openings 88 are formed in the baffle 80 at a location spaced from the central opening 82 in the baffle. The secondary openings 88 extend between an upper major side surface 90 and a lower major side surface 92 (FIG. 3) of the baffle 80.

The upper and lower major side surfaces 90 and 92 of the baffle 80 extend parallel to each other. The annular upper and lower major side surfaces 90 and 92 of the baffle 80 are interconnected by a cylindrical inner minor side surface 94 and a cylindrical outer minor side surface 96 (Flg. 2). The inner and outer minor side surfaces 94 and 96 are disposed in a coaxial relationship with each other. It should be understood that the baffle 80 may have a configuration different than the configuration illustrated in FIGS. 2 and 3.

In the embodiment of the baffle 80 illustrated in FIG. 2, the secondary openings 88 are formed by arcuate slots. Each of the arcuate slots has a center of curvature which is coincident with the center of the annular baffle 80. The arcuate secondary openings 88 are disposed in a circular inner array 102 and a circular outer array 104. The inner and outer arrays 102 and 104 of secondary openings 88 are disposed in a coaxial relationship with the inner and outer minor side surfaces 94 and 96 of the baffle 80. If the baffle 80 is constructed with a central opening 82 having a configuration other than the illustrated circular configuration, the secondary openings 88 may be arranged in arrays having a configuration other than the illustrated circular configuration. For example, if the central opening 82 of the baffle 80 is formed with a plurality of lobes, the inner and outer arrays 102 and 104 of secondary openings 88 would have a lobe shaped configuration corresponding to the lobes of the central opening 82 in the baffle 80. Similarly, if the central opening 82 in the baffle had a polygonal configuration, the secondary openings 88 would be disposed in arrays having a corresponding polygonal configuration.

Although the illustrated secondary openings 88 are formed as slots, it is contemplated that the secondary openings may have a different configuration if desired. For example, the secondary openings 88 may be formed as circular holes disposed in an array about the central opening 82 in the baffle 80.

Although only inner and outer arrays 102 and 104 of secondary openings 88 have been illustrated in FIGS. 2 and 3, it is contemplated that either a greater or lesser number of arrays of secondary openings may be formed in the baffle 80. In the embodiment of the baffle 80 illustrated in FIG. 2, the secondary openings 88 in the inner and outer arrays 102 and 104 are disposed in radial alignment with each other. However, it is contemplated that the openings 88 in the inner array could be offset from the openings in the outer array 104. Thus, the secondary openings 88 may have a random pattern rather than a uniform pattern.

The secondary openings 88 in the baffle 80 enable particulate to move from the upper side 90 of the baffle 80 through the openings to the fluidized bed 34. During use of the casting apparatus 10, particulate may move onto the upper side of the baffle 80. This movement may result from boiling of the fluidized bed 34 or other causes. For example, when the mold 22 is raised from the fluidized bed 34 into the heating chamber 60, particulate may cling to the mold 22 and/or mold support 24 and subsequently be deposited on the baffle 80. As another example, if the fluid pressure conducted through the conduit 50 to the plenum chamber 48 is relatively high, there may be some boiling of the fluidized bed. This boiling of the fluidized bed may result in particulate being projected upwardly from the fluidized bed 34 through the central opening 82 in the baffle 80 onto the upper major side surface 90 of the baffle 80.

The particulate can move downward from the upper side 90 of the baffle 80 through the secondary openings 88 to the fluidized bed 34. This results in particulate which moves onto the baffle 80 being returned to the fluldized bed 34 rather than accumulating on the upper side 90 of the baffle. The secondary openings 88 are effective to impart a self cleaning action to the baffle during operation of the casting apparatus 10.

It is believed that it will be preferred to form the baffle 80 with the secondary openings 88. However. If desired, the secondary openings 88 may be omitted from the baffle 80. Of course, eliminating the secondary openings 88 may, under some circumstances at least, result in accumulation of particulate on the upper side 90 of the baffle 80. This particulate may be transferred to the upper side of the baffle 80 from the fluidized bed during operation of the casting apparatus 10.

Baffle-Secondary Openings

Figure 4:
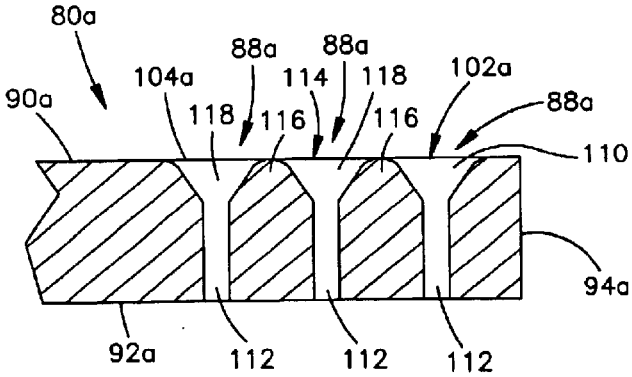
FIG. 4. is a schematic fragmentary sectional view, generally similar to FIG. 3, illustrating an embodiment of the baffle in which the secondary openings have enlarged upper end portions to promote movement of particulate from an upper side of the baffle into the secondary openings.

In the embodiment of the invention illustration in FIG. 3, the secondary openings 88 in the baffle 80 have upper and lower ends with the same cross sectional size. Thus, the secondary openings 88 in the baffle 80 of FIGS. 2 and 3 have a uniform cross sectional configuration, as viewed in a plane extending parallel to the upper and lower side surfaces 90 and 92. In the embodiment of the baffle illustrated in FIG. 4, the secondary openings have relatively large upper end portions and relatively small lower end portions. Since the baffle of FIG. 4 is generally similar to the baffles of FIGS. 1–3, similar numerals will be utilized to designate similar components, the suffix letter "a" being associated with the numerals of FIG. 4 to avoid confusion.

A baffle 80*a* (FIG. 4) has the same configuration as the baffle 80 of FIG. 2. The baffle 80*a* includes a central opening, corresponding to the opening 82 in the baffle 80 of FIG. 2, and a plurality of secondary openings 88*a*. The secondary openings 88*a* extend between an upper major side surface 90*a* and a lower major side surface 92*a* of the baffle 80*a*. The secondary openings 88*a* form passages which extend through the baffle 88*a*. The passages formed by the secondary openings 88*a* have relatively large open upper end portions 110 and relatively small lower end portions 112.

Although the secondary openings 88*a* may have many different configurations, the illustrated secondary openings 88*a* have the same configuration as the secondary openings of FIGS. 2 and 3. Of course, the secondary openings 88*a* of FIG. 4 have relatively large upper end portions 110 while the secondary openings 88 of FIGS. 2 and 3 have a uniform cross sectional configuration throughout their extent.

The relatively large cross sectional configuration, of the upper end portions 110 of the secondary openings 88*a*, facilitates movement of particulate from the upper side surface 90*a* of the baffle 80*a* into the openings 88*a*. The relatively small lower end portions 112 of the openings 88*a* tends to minimize upward flow of particulate from the fluidized bed through the secondary openings 88*a* (FIG. 4) to the upper side surface 0.90*a* of the baffle 80*a*. The secondary openings 88*a* in the baffle 80*a* tend to make the baffles 80*a* self cleaning during use of the casting apparatus 10. This self cleaning action retards the accumulation of particulate on the upper surface 90*a* of the baffle 80*a*.

In the embodiment of baffle 80*a* illustrated in FIG. 4, there are three circular arrays of secondary openings 88*a*. The circular arrays of secondary openings 88*a* are disposed in a coaxial relationship with an inner side surface 94*a* of the baffle 80*a*. Each of the secondary openings 88*a* is formed as an arcuate slot having a center of curvature disposed at the center of the central opening in the baffle 80*a*.

The slots forming the secondary openings 88*a* in the baffle 80*a* have the same arcuate configuration as the slots 88 of FIG. 2. However, there are three circular arrays of secondary openings 88*a* in the baffle 80*a* rather than two arrays as illustrated in FIGS. 2 and 3. Thus, there is a circular inner array 102*a* of secondary openings 88*a* and circular outer array 104*a* of secondary openings 88*a*. An intermediate array 114 of secondary openings 88*a* is disposed between the circular inner array 102*a* and the circular outer array 104*a* of secondary openings 88*a*.

Between the upper end portions 110 of adjacent secondary openings 88*a*, rounded peaks 116 are formed in the baffle 80*a*. The rounded peaks 116 promote movement of particulate from the upper major side surface 90*a* of the baffle 80*a* into the secondary openings 88*a*. Therefore, there is little or no accumulation of particulate on the upper side surface 90*a* of the baffle 80*a*.

Although rounded peaks 116 are provided between secondary openings 88*a* in the baffle 80*a*, sharply defined peaks may be provided if desired. The sharply defined or rounded peaks 116 are tangent to a plane containing the upper side surface 90*a* of the baffle 80*a*. The sharply defined or rounded peaks 116 may be disposed above and/or below the upper side surface 90*a* of the baffle 80*a*. Of course, the secondary openings 88*a* may be spaced further from each other than is illustrated in FIG. 4 with a resulting flat surface area between the upper end portions 110 of adjacent secondary openings 88*a*.

During use of the casting apparatus 10 in the manner previously explained in conjunction with FIG. 1, particulate may be splashed or transferred in other ways to the upper side 90*a* of the baffle 80*a* (FIG. 4). This particulate flows into the relatively wide open end portions 110 of the secondary openings 88*a*. The particulate flows downward through the relatively narrow lower end portions 112 of the secondary openings 88*a* into the fluidized bed 34 (FIG. 1). Therefore, there is little or no accumulation of particulate upper side 90*a* (FIG. 4) of the baffle 80*a*. Flow of particulate into the relatively large upper end portions 110 of the secondary openings 88*a*: is promoted by the peaks 116 disposed between adjacent secondary openings.

Although the secondary openings 88*a* of FIG. 4 are formed as arcuate slots and are arranged in circular arrays, in the same manner as are the secondary openings 88 of FIGS. 2 and 3, the combination of the relatively large upper end portions 110 of the secondary openings 88*a* and the peaks 116 is effective to promote flow of particulate materials into the secondary openings. This tends to minimize any tendency for particulate to accumulate on the upper side of the baffle 80*a*.

Although the baffles 80 and 80*a* of FIGS. 2–4 have been illustrated as having secondary openings 88 and 88*a*, it is contemplated that the secondary openings may be omitted if desired. Omission of the secondary openings 88 and 88*a* would eliminate the self cleaning feature of the baffles 80 and 80*a*. The self cleaning feature provided by the secondary openings 88 and 88*a* minimizes accumulation of particulate on the upper side 90 and 90*a* of the baffles 80 and 80*a* and promotes a return of the particulate to the fluidized bed. If desired, a similar self cleaning effect may be obtained by sloping the upper major side surface 90 of the baffle radially inward and downward toward the central opening 82.

Container Mounted

Baffle

In the embodiment of the invention illustrated in FIGS. 1–4, the baffle 80 is connected with the furnace assembly 12. In the embodiment of the invention illustrated in FIG. 5, the baffle is connected with the container which holds the fluidized bed. Since the embodiment of the invention illustrated in FIG. 5 is generally similar to the embodiments of the invention illustrated in FIGS. 1–4, similar numerals will be utilized to designate similar components, the suffix letter "b" being associated with the numerals of FIG. 5.

Figure 5:
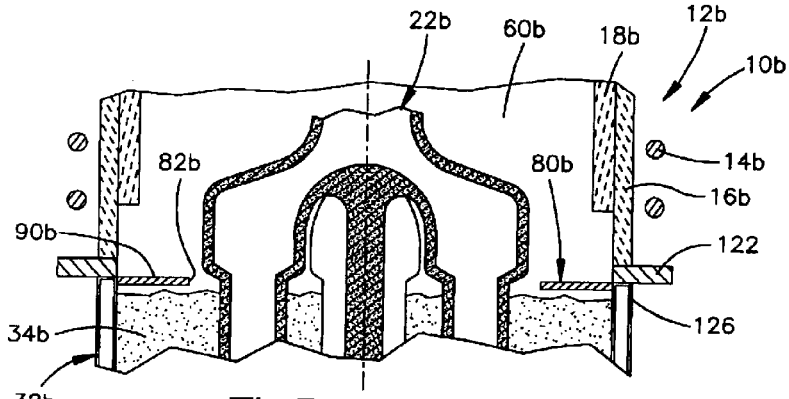
FIG. 5. is a fragmentary schematic sectional view, generally similar to a portion of the apparatus of FIG. 1, and illustrating the relationship between a furnace assembly, a container for holding the fluidized bed, and a baffle which is connected with the container.

A casting apparatus 10*b* includes a furnace assembly 12*b* (FIG. 5). The furnace assembly 12*b* includes an induction coil 14*b*, a refractory wall 16*b* and a liner 18*b*. An annular ring 122 is provided at the lower end portion of the furnace assembly 12*b*. A mold 22*b* is disposed on a mold support, corresponding to the mold support 24 of FIG. 1.

The mold support and mold 22*b* are movable in an upward direction, as viewed in FIG. 5, to move the mold into the cylindrical heating chamber 60*b* of the furnace assembly 12*b*. The mold support and the mold 22*b* are movable in a downward direction (as viewed in FIG. 5) to move the mold 22*b* from the heating chamber 60*b* of the furnace assembly 12*b* into a fluidized bed 34*b* disposed in a container 32*b*. The fluidized bed 34*b* and container 32*b* are movable toward and away from the furnace assembly 12*b* by a container drive assembly corresponding to the container drive assembly 42 of FIG. 1.

The manner in which the mold 22*b* is moved into and out of the furnace assembly 12*b* during casting of an article and the manner in which the mold 22*b* and molten metal in the mold are cooled during use of the casting apparatus 10*b* is the same as was previously described in conjunction with the casting apparatus 10 of FIG. 1. As was previously mentioned, the casting apparatus 10*b* may have any one of the constructions disclosed in U.S. Pat. No. 6,443,213 and/or in U.S. patent application Ser. No. 10/189,656 filed Jul. 3, 2002 by Lawrence D. Graham (Publication No. 20020170698-A1). The aforementioned U.S. Pat. No. 6,443,213 and patent application Ser. No. 10/189,656 are hereby incorporated herein in their entirety.

In accordance with a feature of the embodiment of the invention illustrated in FIG. 5, an annular baffle 80*b* is connected with an upper end portion 126 of the container 32*b*. The baffle 80*b* is disposed above and is spaced from the fluidized bed 34*b*. The baffle 80*b* is moved relative to the furnace assembly 12*b* with the container 32*b* during use of the casting apparatus 10*b*. The baffle 80*b* is fixedly connected with the upper end portion 126 of the container 32*b* by suitable fasteners and/or brackets. For example, an annular bracket may be connected with both the baffle 80*b* and the upper end portion 126 of the container 32*b* to fixedly secure the baffle 80*b* to the container.

The annular baffle 80*b* has a circular central opening 82*b* corresponding the circular central opening 82 in the baffle 80 of FIG. 2. Although the baffle 80*b* has an annular configuration, it is contemplated that the baffle could have a different configuration if desired. For example, the central opening 82*b* may have a noncircular configuration.

The baffle 80*b* does not have secondary openings corresponding to the secondary openings 88 in the baffle 80 of FIGS. 2 and 3. However, the baffle 80*b* may be provided with secondary openings corresponding to either the secondary openings 88 of FIGS. 2 and 3 or the secondary openings 88*a* of FIG. 4. Alternatively, the baffle 80*b* may be provided with secondary openings having a configuration which is different than the configuration of the secondary openings 88 and 88*a* of FIGS. 2–4.

During operation of the casting apparatus 10*b*, the mold 22*b* is moved into the furnace assembly 12*b*. The container 32*b* and baffle 80*b* are simultaneously raised to the position shown in FIG. 5. Molten metal is poured into the mold 22*b*. The mold 22*b* is then withdrawn from the furnace assembly 12*b* and moved into the fluidized bed 34*b*. As the mold 22*b* moves into the fluidized bed, the molten metal in the mold 22*b* solidifies with a desired crystallographic structure.

As the mold 22*b* is withdrawn from the furnace assembly 12*b*, the mold moves downward through the central opening 82*b* in the stationary baffle 80*b*. There is no significant deformation of the baffle 80*b* as the mold 22*b* moves through the central opening 82*b* in the baffle.

After the mold 22*b* has been withdrawn from the furnace assembly 12*b* through the central opening 82*b* in the baffle 80*b*, the container 32*b*, fluidized bed 34*b* and baffle 80*b* are moved downward away from the furnace assembly 12*b* by operation of a container drive assembly, corresponding to the container drive assembly 42 of FIG. 1. At the same time, the mold 22*b* and mold support are moved downward with the fluidized bed 34*b* and container 32*b* by operation of a mold support drive assembly, corresponding to the mold support drive assembly 36 of FIG. 1. Since the baffle 80*b* is connected with the container 32*b*, the baffle 80*b* moves downward away from the furnace assembly 12*b* with the container 32*b* and fluidized bed 34*b*. The mold support drive assembly 36 is operated to move the mold 22*b* downward with the container 32*b*, fluldized bed 34*b* and baffle 80*b*.

The illustrated baffle 80*b* (FIG. 5) does not have any secondary openings corresponding to the secondary openings 88 and 88*a* of FIGS. 1–4. Therefore, particulate which splashes onto the annular upper side surface 90*b* of the baffle 88*b* may tend to accumulate on the upper side surface 90*b*. To reduce the tendency for the particulate to accumulate on the upper side surface 90*b* of the baffle 80*b*, the upper side surface of the baffle may slope radially inward and downward to the central opening 82*b* in the baffle. This results in the upper surface 90*b* of the baffle 80*b* forming a ramp along which particulate moves downward to the central opening 82*b* and to the fluidized bed 34*b*. Of course, secondary openings could be provided in the ramp formed by the upper surface 90*b* of the baffle 80*b*.

Floating Baffle

Figure 6:
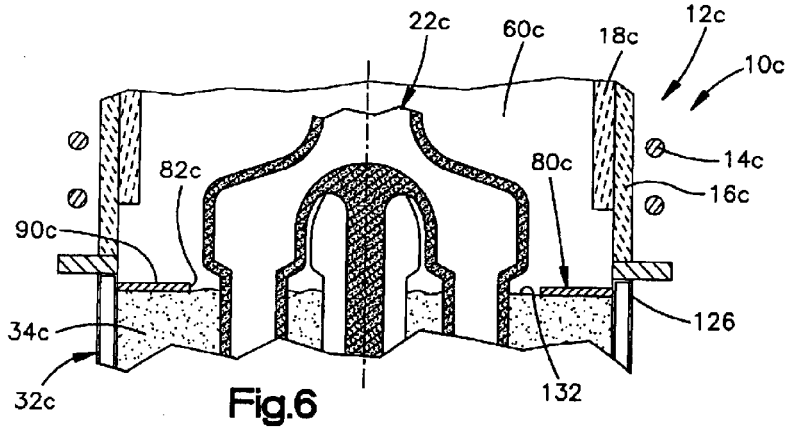
FIG. 6. is a schematic fragmentary sectional view, generally similar to FIG. 5, illustrating the manner in which a baffle floats on the fluidized bed.

In the embodiment of the invention illustrated in FIG. 5, the baffle 80*b* is fixedly connected to the container 32*b* and is disposed above the fluidized bed 34*b*. In the embodiment of the invention illustrated in FIG. 6, the baffle floats on the fluidized bed. Since the embodiment of the invention illustrated in FIG. 6 is generally similar to the embodiments of the invention illustrated in FIGS. 1–5, similar numerals will be utilized to designate similar components, the suffix letter "c" being associated with the numerals of FIG. 6 to avoid confusion.

A casting apparatus 10*c* includes a furnace assembly 12*c*. The furnace assembly 12*c* has an induction coil 14*c* which extends around a cylindrical refractory wall 16*c* and a cylindrical liner 18*c*. The furnace assembly 12*c* has a cylindrical heating chamber 60*c*.

A mold 22*c* is provided to cast metal articles. The mold 22*c* is provided with a plurality of article mold cavities. However, the mold 22*c* could be formed with a single article mold cavity.

Although the mold 22*c* may have any one of many different constructions, the illustrated mold 22*c*, like the molds 22 and 22*b* of FIGS. 1 and 5, has the same general construction as is disclosed in U.S. Pat. Nos. 4,774,992; 5,046,547; 5,062,468; and 5,295,530. The molds in these patents have a plurality of article mold cavities to enable a plurality of articles to be cast at one time. However, the mold 22, 22*b* or 22*c* may be constructed for the casting of only a single article in the manner disclosed in U.S. Pat. No. 4,862,947. The molds 22, 22*b*, and 22*c* may be formed of a mold material similar to the mold material disclosed in U.S. Pat. No. 4,947,927.

The molds 22, 22*b*, and 22*c* are integrally formed as one piece by repetitively dipping a wax pattern in a slurry of ceramic mold material in the manner disclosed in U.S. Pat. No. 4,955,423. However, it should be understood that the molds may be formed in many different ways and may be utilized to cast many different articles for use in environments other than in association with turbine engines. It is believed that the present invention will advantageously be used in conjunction with the casting of many types of articles and it is not intended to limit the invention to any specific mold construction, type of mold, article, or type of article.

The mold 22*c* is raised into the heating chamber 60*c* by operation of a mold support drive assembly, corresponding to the mold support drive assembly 36 of FIG. 1. When the mold 22*c* has been heated to a desired temperature, the mold is filled with molten metal. At this time, a container 32*c* and a fluidized bed 34*c* will have been moved to the raised position illustrated schematically in FIG. 6. When the container 32*c* and fluidized bed are disposed in the raised position of FIG. 6, they are disposed immediately beneath the furnace assembly 12*c*.

Once the molten metal has been poured into the mold 22*c*, the mold lis lowered into the fluidized bed 34*c* In the raised container 32*c*. This is accomplished by operating the mold support drive assembly, corresponding to the mold support drive assembly 36 of FIG. 1, to lower the mold 22*c* relative to the stationary container 32*c* and fluidized bed 34*c*. As this occurs, the molten metal in the mold solidifies along a solidification front which is disposed in a portion of the mold 22*c* (FIG. 6) adjacent to the upper surface of the fluidized bed 34*c*.

The solidification front separates the molten metal in the upper portion of the mold 22*c* from solid metal in the lower portion of the mold. A cellular solidification front may be achieved by slowly lowering the mold 22*c* into the fluidized bed 34*c*. If this is done, the resulting cellular solidification front is free of dendrites which commonly project from a solidification front during solidification of molten metal. The absence of dendrites is obtained with a cellular solidification front due to the high rate in which heat is transferred from the mold 22*c* and the relatively low rate of lowering the mold into the fluidized bed.

It should be understood that the mold 22*c* may be lowered into the fluidized bed 34*c* in a manner which results in solidification of the molten metal along a dendritic solidification front. When the solidification front is either a dendritic solidification front or a cellular solidification front, the front has an horizontal configuration and extends across the metal and all of the article mold cavities at a location adjacent to the upper surface of the fluidized bed 34*c*.

In accordance with a feature of the embodiment of the invention illustrated in FIG. 6, a baffle 8° C. is disposed on an upper surface 132 of the fluidized bed 34*c*. The baffle 80*c* floats on the upper surface 132 of the fluidized bed 34*c*. Both the fluidized bed 34*c* and the baffle 80*c* are disposed within the container 32*c*.

The baffle 80*c* has an annular configuration, corresponding to the annular configuration of the baffle 80 of FIG. 2. The baffle 80*c* has a circular central opening 82*c*. An upper side surface 90*c* of the baffle 80*c* is circumscribed by the container 32*c*. There is no significant deformation of the baffle 80*c* as the mold 22*c* moves through the central openings 82*c* in the baffle. As was previously mentioned, the baffle may have a configuration which is different than the illustrated annular configuration. The baffle 80*c* is formed of a relatively light material which is capable of floating on the fluidized bed 34*c*. Although the baffle 80*c* may be formed of many different materials, it is believed that it may be desired to form the baffle 80*c* from a low density graphite foam. Of course, the baffle 80*c* could be formed of other material if desired and have a configuration which is is different than the illustrated configuration.

Since the baffle 80*c* floats on the upper surface 132 of the fluidized bed 34*c*, the baffle will move in the fluidized bed with movement of the upper surface of the fluidized bed. For example, if the volume of the fluidized bed 34*c* in the container 32*c* is reduced, the baffle 80*c* will move downward in the container 32*c* as the upper surface 132 of the fluidized bed moves downward in the container. Similarly, as the upper surface 132 of the fluidized bed 34*c* moves upward in the container 32*c*, the baffle 80*c* will move upward in the container.

The baffle 80*c* is free of secondary openings corresponding to the secondary openings 88 and 88*a* of FIGS. 2–4. However, it is believed that it may be desired to form secondary openings in the baffle 80*c*. These openings may have a configuration corresponding to the configuration of the openings 88 in the baffle 80 of FIG. 2. It is contemplated that the number of secondary openings formed in the baffle 80*c* may be either greater or lesser than the number of secondary openings 88 formed in the baffle 80. Since the baffle 80*c* is floating on the fluidized bed 34*c*, it is believed that it may be desired to form the secondary openings in the baffle with relatively small lower end portions and relatively large upper end portions in the manner previously described in conjunction with the secondary openings 88*a* in the baffle 80*a* of FIG. 4.

Flexible Baffle Segments

Figure 7:
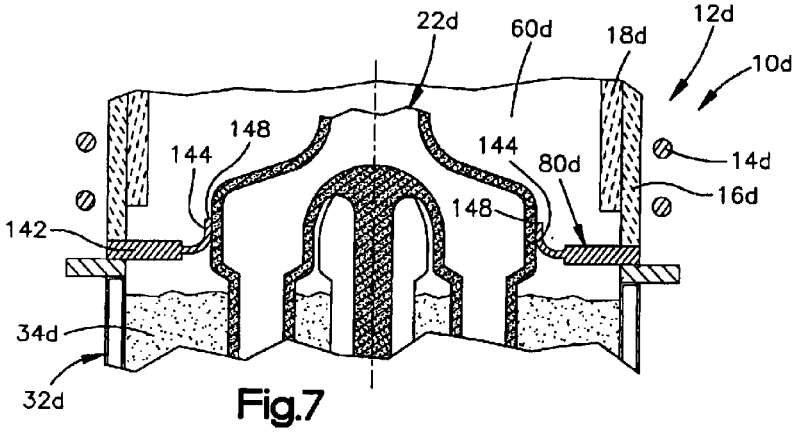
FIG. 7. is a schematic fragmentary sectional view, generally similar to FIGS. 5 and 6, illustrating a baffle having flexible segments which engage a mold during movement of the mold through a central opening in the baffle.

The central openings 82, 82*b* and 82*c* formed in the baffles 80, 80*b*, and 80*c* of FIGS. 2, 5, and 6 are sized so that the mold 22*c* can move through the central opening without significantly deforming the baffle. In the embodiment of the invention illustrated in FIG. 7, the baffle is provided with flexible segments which are deformed as the mold moves through the central opening in the baffle. Since the embodiment of the invention of the illustrated in FIG. 7 is generally similar to the embodiments of the invention illustrated in FIGS. 1–6, similar numerals will be utilized to designate similar components, the suffix letter "d" being associated with the numerals of FIG. 7 to avoid confusion.

A casting apparatus 10*d* has the same general construction and mode of operation as the casting apparatus 10 of FIG. 1. The casting apparatus 10*d* includes a furnace assembly 12*d*. The furnace assembly 12*d* includes a induction coil 14*d*, a cylindrical refractory wall 16*d* and a cylindrical wall 18*d*. The furnace assembly 12*d* has a cylindrical heating chamber 60*d*.

A mold 22*d* is movable into and out of the furnace chamber 60*d* by operation of a mold support drive assembly, corresponding to the mold support drive assembly 36 of FIG. 1. The mold 22*d* is moved into the heating chamber 60*d* and preheated to a desired temperature. Molten metal is then poured into the mold 22*d*. After the molten metal has been poured into the mold 22*d*, the mold is withdrawn from the furnace assembly 12*d* by operation of the mold support drive assembly.

At this time, a container 32*d* and a fluidized bed 34*d* will have been moved to a raised position immediately beneath the furnace assembly 12*d* by a container drive assembly, corresponding to the container drive assembly 42 of FIG. 1. As the mold 22*d* is lowered from the heating chamber 60*d* into the fluidized bed 34*d* by operation of the mold support drive assembly, molten metal will solidify in the mold in the manner previously described herein.

A baffle 80*d* is connected to the furnace assembly 12*d* in the same manner as previously described in conjunction with in the embodiment of the invention illustrated in FIG. 1. However, the baffle 80*d* may be connected with the container 32*d* in the same manner as previously described in conjunction with the embodiment of the invention illustrated in FIG. 5. Alternatively, the baffle 80*d* may be floated on the fluidized bed 34*d* in the same manner as previously described in conjunction with the embodiment of the invention illustrated in FIG. 6.

The baffle 80*d* is effective to retard the radiant transmission of heat from the heating chamber 60 of the furnace assembly 12 to the fluidized bed 34*d*. In addition, the baffle 80*d* is effective to retard the radiant transfer! of heat from a portion of the mold 22*d* disposed above the baffle to the fluidized bed 34*d*. The baffle 80*d* is also effective to retard movement of particulate from the fluidized bed 34*d*.

The baffle 80*d* includes an annular base 142 which is secured to the furnace assembly 12*d*. A plurality of flexible segments 144 are connected to the base 142 and are engagable with the outside of the mold 22*d*. Ends 148 of the flexible segments 144 cooperate to define a central opening, corresponding to the central opening 82 of FIG. 2, through the baffle 80*d*.

Although the ends 148 of the flexible segments 144 define a circular central opening corresponding to the central opening 82 of FIG. 2, it is contemplated that the opening may have a different configuration if desired. For example, the opening defined by the flexible segments 144 may have a configuration which is a function of the configuration of the mold 22*d*. The central opening may have a noncircular configuration with a plurality of arms or lobes to receive a plurality of portions of the mold 22*d*.

The base 142 of the baffle 80*d* includes an annular upper layer and an annular lower layer. The annular upper and lower layers may be formed as a plurality of separate segments which are interconnected at expansion joints. If desired, the base 142 may have a noncircular configuration. The annular upper and lower layers of the base 142 may be formed of graphite. In the embodiment of the baffle 80*d* illustrated in FIG. 7, the base 142 is free of openings corresponding to the secondary openings 88 of FIGS. 2 and 3 and 88*a* of FIG. 4. However, if desired, secondary openings 88 or 88*a* may be provided in the base 142 of the baffle 80*d*. The provision of secondary openings 88 or 88*a* in the base 142 would make the baffle self cleaning of particulate during use of the apparatus 10*d*.

The flexible segments 144 may be formed from a single circular piece of graphite foil. The flexible segments 144 are formed as separate cantilevered beams or arms which extend radially inward from the annular base 142.

As the mold 22*d* moves into and out of the heating chamber 60*d* of the furnace assembly 12*d*, the flexible segments 144 of the baffle 80*d* are resiliently flexed by the mold 22*d*. The extent to which the flexible segments 144 are deflected varies as a function of the configuration of the irregular side portion of the mold 22*d*.

As the mold 22*d* is moved upward into the heating chamber 60*d*, forces are transmitted from the irregular side portion of the mold 22*d* to flex the segments 144 radially outward and upward in the manner illustrated schematically in FIG. 7. During upward movement of the mold 22*d* into the heating chamber 60*d* of the furnace assembly 12*d*, the flexible segments block upward movement of particulate from the fluidized bed 34*d*. In addition, the flexible segments tend to wipe down the outer side surface of the mold 22*d* to dislodge any particulate which may be adhering to the mold. The particulate which is removed from the exterior surface of the mold 22*d* by the wiping action of the flexible segments 144 flows downward into the fluldized bed 34*d*. The natural resilience of the material forming flexible segments 144 causes segments to flex radially inward and outward with variations in the irregular outer side surface of the mold 22*d*.

After preheating the mold 22*d* and pouring the molten metal into the mold, the mold 22*d* is lowered by operation of a mold support drive assembly, corresponding to the mold support drive assembly 36 of FIG. 1. As the mold 22*d* is lowered the container 32*d* and fluidized bed 34*d* remain stationary relative to the furnace assembly 12*d*.

As the mold 22*d* is lowered, the flexible segments 144 of the baffle 80*d* flex to maintain engagement with the irregular side portion of the mold structure. Thus, as the configuration or contour of the irregular side portion of the mold 22*d* changes along the length of the mold, the segments 144 flex in and out to maintain engagement with the side portion of the mold 22*d*. The segments 144 are resiliently flexed outward by force transmitted from! the mold 22*d* to the segments. The segments 144 are flexed inward by their own natural resilience to either maintain contact with an inwardly curving contour of the irregular side portion of the mold 22*d* or to assume their initial flat or straight condition. The flexible segments block movement of particulate from the fluidized bed 34*d* through the baffle 80*d* as the mold 22*d* is lowered into the fluidized bed.

As the mold 22*d* is lowered, the flexible segments 144 of the baffle 80*d* tend to remain deflected upwardly as shown in FIG. 7. As the mold 22*d* moves downward, the upturned flexible segments 144 of the baffle 80*d* wipe along the surfaces of the mold 22*d*. If the outer end 148 of an upturned flexible segment 144 encounters a discontinuity or protuberance on the mold 22*d*, the end 148 may catch on the discontinuity or protuberance and be pulled downwardly with the mold 22*d*. This would result in an upwardly deflected flexible segment 144 being resiliently flexed to a downward extending orientation. Thus, as the mold 22*d* moves downward through the baffle 80*d*, at least some of the flexible segments 144 may be pointed upwardly while other flexible segments are pointed downward.

When the mold 22*d* has been moved downward to through sufficient distance into the fluidized bed 34*d*, the upper portion of the mold 22*d* may move out of engagement with the flexible segments 144. Alternatively, when the fluidized bed 34*d* and container 32*d* have been moved downward through a sufficient distance, the upper end portion of the mold 22*d* may move out of engagement with the flexible segments 144. When the mold 22*d* moves out of engagement with the flexible segments 144, the flexible segments return to their initial straight, that is, flat, condition under the influence of their own natural resilience.

It Is contemplated that the baffle 80*d* may have many different constructions. However, a specific baffle 80*d* which has been illustrated schematically in FIG. 7 has the same construction as the baffle disclosed in U.S. Pat. No. 4,969,501 to Brokloff, et al. The disclosure in the aforementioned U.S. Pat. No. 4,969,501 is hereby incorporated herein in its entirety by this reference thereto. Alternatively, the baffle 80*d* may have the same construction disclosed in U.S. patent application Ser. No. 10/282,735, filed Oct. 29, 2002 by Robert M. Garlock, et al. The disclosure in the aforementioned application Ser. No. 10/282,735 is hereby incorporated herein in its entirety by this reference thereto.

Although the baffle 80*d* has been illustrated in FIG. 7 as being connected to the furnace assembly 12*d*, the baffle may be connected to the container 32*d* in the manner illustrated in FIG. 5. When the baffle 80*d* is fixedly connected to the container 32*d*, the baffle is moved with the container relative to the furnace assembly 12*d*. Thus, the container 32*d* and baffle 80*d* would be simultaneously moved upward toward the furnace assembly 12*d*. Similarly, the container 32*d* and baffle 80*d* would be simultaneously moved downward away from the furnace assembly 12*d*.

CONCLUSION

In view of the foregoing description, it is apparent that the present invention provides a new and improved method and apparatus 10 for use in casting a metal article. During casting of the metal article, a mold 22 is moved into a fluidized bed 34. A baffle 80 is provided to retard heat transfer from a furnace assembly 12 to a fluidized bed 34 during heating of a mold 22 in the furnace assembly. In addition, the baffle 80 retards transfer of heat from a portion of the mold 22 disposed outside of the fluidized bed 34 to the fluidized bed during movement of the mold into the fluidized bed.

The baffle 80 may be connected with the furnace assembly 12. Alternatively, the baffle 80*b* may be connected with a container 32*b* which holds the fluidized bed 34*b*. As another alternative, the baffle 80*c* may float on the fluidized bed 34*c*. Regardless of how the baffle 80 is supported, the baffle may be provided with flexible segments 144 which engage the mold 22 during movement of the mold through a central opening 82 in the baffle to at least partially block movement of particulate through the central opening in the baffle and to block radiation of heat through the central opening in the baffle.

The baffle 80 may have a central opening 82 and a plurality of secondary openings 88. The secondary openings 88 enable particulate to move from an upper side 90 of the baffle 80 into the fluidized bed 34. This tends to minimize accumulation of particulate on the upper side 90 of the baffle 80. If desired, the secondary openings 88 may be omitted.

It should be understood that any one of the features mentioned above and/or additional features may be utilized by itself or in combination with other features of the invention. It should also be understood that the invention is not to be limited to any one of the specific embodiments disclosed herein. This is because there are many different ways in which the various features of the invention may be used together or separately and in which they may be changed from the specific embodiments disclosed herein. For example, the baffle 80 may be constructed with or without the secondary openings 88. As another example, any one of the baffles 80, 80*a*, 80*b* or 80*c* may be provided with flexible segments 144. As still another example, any one of the baffles 80*b*, 80*c* or 80*d* may be constructed with secondary openings.

Having described the invention, the following is claimed:

1. An apparatus for use in casting a metal article, said apparatus comprising a furnace assembly, a container which holds a fluidized bed, a mold support which is movable relative to the furnace assembly to move a mold between said the furnace assembly and the fluidized bed, and a baffle which is fixedly connected with said container and is disposed between the fluidized bed and at least a portion of said furnace assembly, said baffle having a central opening through which at least a portion of the mold moves during movement of the mold between said furnace assembly and the fluidized bed.

2. An apparatus as set forth in claim 1 wherein said baffle has a plurality of secondary openings to enable particulate to move from an upper side of said baffle through the secondary openings into the fluidized bed.

3. An apparatus as set forth in claim 2 wherein the secondary openings have upper end portions with a relatively large cross sectional area and lower end portions with a relatively small cross sectional area to promote movement of particulate into the upper end portions of the secondary openings and to retard movement of particulate into the lower end portions of the secondary openings.

4. An apparatus as set forth in claim 1 wherein said baffle is disposed above and is spaced from the fluidized bed.

5. An apparatus as set forth in claim 1 wherein said baffle includes a base and a plurality of flexible segments which extend from said base, said flexible segments being engagable with the mold during at least a portion of the movement of the mold through the central opening in said baffle, said flexible segments being effective to retard movement of particulate from the fluidized bed through the central opening in said baffle during movement of the mold through the central opening in said baffle.

6. An apparatus as set forth in claim 1 wherein said baffle includes a plurality of flexible segments having end portions which are engagable with the mold during at least a portion of the movement of the mold through the central opening in said baffle to retard movement of particulate through the central opening in said baffle, said flexible segments of said baffle being resiliently deflectable under the influence of force applied against said flexible segments by the mold.

7. A method of casting a metal article, said method comprising the steps of moving a mold into a furnace assembly, moving the mold from the furnace assembly into a fluidized bed, said step of moving the mold from the furnace assembly into the fluidized bed includes moving at least a portion of the mold through a central opening in a baffle without significantly deforming the baffle, and supporting the baffle with a container in which the fluidized bed is disposed during movement of the mold through the central opening in the baffle.

8. A method as set forth in claim 7 further including the step of conducting particulate from an upper side of the baffle toward the fluidized bed through a plurality of secondary openings formed in the baffle.

9. A method as set forth in claim 7 further including the step of maintaining the baffle in a spaced apart relationship with the fluidized bed during movement of the mold through the central opening in the baffle.

10. A method as set forth in claim 7 further including moving the container, the mold and the baffle away from the furnace assembly after moving the mold from the furnace assembly into the fluidized bed.

11. A method of casting a metal article, said method comprising the steps of moving a mold into a furnace assembly, supporting a baffle above a fluidized bed disposed in a container by transmitting force between the baffle and the container, and moving at least a portion of the mold from the furnace assembly through a central opening in the baffle into the fluidized bed while the baffle is supported by the container.

12. A method as set forth in claim 11 wherein said step of moving the mold from the furnace assembly through a central opening in the baffle is performed without significantly deforming the baffle.

13. A method as set forth in claim 11 further including the step of conducting particulate from an upper side of the baffle toward the fluidized bed through a plurality of secondary openings formed in the baffle.

14. A method as set forth in claim 11 further including the step of maintaining the baffle in a spaced apart relationship with the fluidized bed during movement of the mold through the central opening in the baffle.

15. A method as set forth in claim 11 further including the step of moving the container, mold and baffle away from the furnace assembly after moving the mold from the furnace assembly into the fluidized bed.

16. A method as set forth in claim 11 wherein the baffle includes a plurality of flexible segments, said method further includes at least partially blocking movement of particulate through the central opening in the baffle by engaging the mold with the flexible segments of the baffle during at least a portion of the movement of the mold through the central opening in the baffle into the fluidized bed.

17. A method as set forth in claim 11 wherein the baffle includes a plurality of flexible segments, said method further includes the steps of resiliently flexing the flexible segments of the baffle under the influence of force transmitted from the mold to the flexible segments of the baffle during at least a portion of the movement of the mold through the central opening in the baffle.

18. A method as set forth in claim 11, wherein the baffle includes a base and a plurality of flexible segments which extend from the base, said step of moving the mold from the furnace assembly into the fluidized bed includes deflecting the flexible segments of the baffle relative to the base of the baffle under the influence of force transmitted from the mold to the flexible segments of the baffle.

19. A method as set forth in claim 11 wherein the baffle includes a base and a plurality of flexible segments which extend from the base and at least partially define the central opening in the baffle, said step of moving the mold through the central opening in the baffle is at least partially performed with said flexible segments of the baffle spanning a space between the mold and the base of the baffle to retard movement of particulate from the fluidized bed through the space between the mold and the base of the baffle.

20. A method of casting a metal article, said method comprising the steps of moving a mold into a furnace assembly, moving the mold from the furnace assembly into a fluidized bed, said step of moving the mold from the furnace assembly into the fluidized bed includes moving at least a portion of the mold through a central opening in the baffle, conducting particulate from an upper side of the baffle toward the fluidized bed through a plurality of secondary openings in the baffle, and maintaining the baffle in a spaced apart relationship with the fluidized bed during movement of the mold through the central opening in the baffle.

21. A method as set forth in claim 20 wherein said step of moving the mold through the central opening in the baffle is performed without significantly deforming the baffle.

22. A method as set forth in claim 20 further including the step of supporting the baffle with the furnace assembly during movement of the mold through the central opening in the baffle.

23. A method as set forth in claim 20 further including the step of supporting the baffle with a container in which the fluidized bed is disposed during movement of the mold through the central opening in the baffle.

24. A method as set forth in claim 20 wherein the fluidized bed is disposed in a container during movement of the mold from the furnace assembly into the fluidized bed, said method further includes moving the container and the mold away from the furnace assembly and baffle after moving the mold from the furnace assembly into the fluidized bed.

25. A method as set forth in claim 20 wherein the fluidized bed is disposed in a container during movement of the mold from the furnace assembly into the fluidized bed, said method further includes moving the container, mold and baffle away from the furnace assembly after moving the mold from the furnace assembly into the fluidized bed.

26. A method as set forth in claim 10 wherein the baffle includes a plurality of flexible segments, said method further includes at least partially blocking movement of particulate through the central opening in the baffle by engaging the mold with the flexible segments of the baffle during at least a portion of the mold through the central opening in the baffle.

27. A method as set forth in claim 21 wherein the baffle includes a plurality of flexible segments, said method further includes the steps of resiliently flexing the flexible segments of the baffle under the influence of force transmitted from the mold to the flexible segments of the baffle during at least a portion of the movement of the mold through the central opening in the baffle.

28. A method as set forth in claim 10 wherein the baffle includes a base and a plurality of flexible segments which extend from the base, said step of moving the mold from the furnace assembly into the fluidized bed includes deflecting the flexible segments of the baffle relative to the base of the baffle under the influence of force transmitted from the mold to the flexible segments of the baffle.

29. A method as set forth in claim 20 wherein the baffle includes a base and a plurality of flexible segments which extend from the base and at least partially define the central opening in the baffle, said step of moving the mold through the central opening in the baffle is at least partially performed with said flexible segments of the baffle spanning a space between the mold and the base of the baffle to retard movement of particulate from the fluidized bed through the space between the mold and the base of the baffle.

30. A method of casting a metal article, said method comprising the steps of moving at least a portion of a mold containing molten metal from a furnace assembly into a fluidized bed formed of particulate suspended in a flow of gas, said step of moving the mold from the furnace assembly into the fluidized bed includes moving at least a portion of the mold through a baffle, solidifying the molten metal in the mold as the mold moves into the fluidized bed, and moving the fluidized bed and the baffle away from the furnace assembly with the mold at least partially disposed in the fluidized bed.

31. A method as set forth in claim 30 wherein the fluidized bed is disposed in a container, said method further includes supporting the baffle by transmitting force between the baffle and the container.

32. A method as set forth in claim 31 wherein said step of moving at least a portion of the mold through a baffle includes moving at least a portion of the mold through a central opening in the baffle while supporting the baffle by transmitting force between the baffle and the container.

33. A method as set forth in claim 30 wherein said step of moving at least a portion of the mold through the baffle is performed without significantly deforming the baffle.

34. A method as set forth in claim 30 wherein the baffle includes a plurality of flexible segments, said step of moving at least a portion of the mold through the baffle includes flexing the flexible segments of the baffle.

35. A method as set forth in claim 30 wherein said step of moving at least a portion of the mold through the baffle includes moving at least a portion of the mold through a central opening in the baffle.

36. A method as set forth in claim 35 further including the step of conducting particulate from an upper side of the baffle toward the fluidized bed through a plurality of secondary openings formed in the baffle.

37. A method of casting a metal article, said method comprising the steps of moving at least a portion of a mold containing molten metal from a furnace assembly into a fluidized bed formed of particulate suspended in a flow of gas, said step of moving a mold from the furnace assembly into the fluidized bed includes resiliently flexing flexible segments of a baffle under the influence of force transmitted from the mold to the flexible segments of the baffle, solidifying molten metal in the mold as the mold moves into the fluidized bed, and supporting the baffle by transmitting force between the baffle and a container which holds the fluidized bed.

38. A method as set forth in claim 37 further including the step of moving the fluidized bed away from the furnace assembly with the mold at least partially disposed in the fluidized bed.

39. A method as set forth in claim 37 further including the step of conducting particulate from an upper side of the baffle through a plurality of openings formed in the baffle at locations spaced from the flexible segments of the baffle.

40. A method as set forth in claim 37 wherein said step of moving the mold from the furnace assembly into the fluidized bed is at least partially performed with the baffle disposed above and spaced from the fluidized bed.

41. A method as set forth in claim 37 wherein the baffle includes a base and a plurality of flexible segments which extend from the base, said step of flexing flexible segments of the baffle includes moving the flexible segments of the baffle relative to the base.

42. An apparatus for use in casting a metal article, said apparatus comprising a furnace assembly, a container which holds a fluidized bed, a baffle connected to said container, and a mold support which is movable relative to the furnace assembly to move at least a portion of the mold from the furnace assembly through the baffle into the fluidized bed in said container.

43. An apparatus as set forth in claim 42 wherein said baffle has a plurality of openings to enable particulate to move from an upper side of said baffle through the openings into the fluidized bed.

44. An apparatus as set forth in claim 42 wherein said baffle is disposed above and is spaced from the fluidized bed.

45. An apparatus as set forth in claim 42 wherein said baffle includes a plurality of flexible segments, said flexible segments of said baffle being resiliently deflectable under the influence of force applied against said flexible segments by the mold.

46. An apparatus as set forth in claim 42 further including a container drive assembly connected with said container and operable to move said container and baffle relative to said furnace assembly.

47. An apparatus as set forth in claim 42 wherein said container and baffle are movable relative to said furnace assembly between a raised position in which said baffle is disposed adjacent to said furnace assembly and a lowered position in which said baffle is disposed below said furnace assembly, said apparatus further includes a container drive assembly which is connected with said container and is operable to move said container and baffle between the raised and lowered positions.

* * * * *

UNITED STATES PATENT AND TRADEMARK OFFICE

CERTIFICATE OF CORRECTION

PATENT NO. : 6,889,747 B2
DATED : May 10, 2005
INVENTOR(S) : Lawrence D. Graham

It is certified that error appears in the above-identified patent and that said Letters Patent is hereby corrected as shown below:

Column 18,
Line 61, after "claim" change "10" to -- 20 --.

Column 19,
Line 1, after "claim" change "21" to -- 20 --.
Line 8, after "claim" change "10" to -- 20 --.

Signed and Sealed this

Sixteenth Day of August, 2005

JON W. DUDAS
*Director of the United States Patent and Trademark Office*